US006364966B1

(12) United States Patent
Ohashi et al.

(10) Patent No.: US 6,364,966 B1
(45) Date of Patent: Apr. 2, 2002

(54) METHOD FOR MANUFACTURING ACOUSTIC VIBRATION PLATE

(75) Inventors: Yoshio Ohashi, Kanagawa; Masaru Uryu, Chiba, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/713,718

(22) Filed: Nov. 15, 2000

(30) Foreign Application Priority Data

Nov. 17, 1999 (JP) ..... 11-327260

(51) Int. Cl.[7] ..... C23C 8/06

(52) U.S. Cl. ..... 148/281; 148/284; 148/669; 148/670; 148/712; 181/168

(58) Field of Search ..... 148/281, 284, 148/669, 670, 712; 181/168, 169

(56) References Cited

U.S. PATENT DOCUMENTS 4,344,503 A * 8/1982 Nakamura et al. ..... 181/170

FOREIGN PATENT DOCUMENTS

| | | | |
|---|---|---|---|
| JP | 357093796 A | * | 6/1982 |
| JP | 02-152399 | * | 6/1990 |
| JP | 03-036257 | * | 2/1991 |

* cited by examiner

*Primary Examiner*—John P Sheehan
*Assistant Examiner*—Andrew L. Oltmans
(74) *Attorney, Agent, or Firm*—Jay H. Maioli

(57) ABSTRACT

A method for manufacturing an acoustic vibration plate includes molding titanium metal into a shape of an acoustic vibration plate in order to obtain a titanium vibration plate, and performing a heat treatment on the titanium vibration plate by a ceramic-formation step, thereby to change entirely the titanium vibration plate into titanium oxide.

2 Claims, 4 Drawing Sheets

METHOD FOR MANUFACTURING ACOUSTIC VIBRATION PLATE

BACKGROUND OF THE INVENTION

1. Field of the Invention

The present invention relates to a method for manufacturing an acoustic vibration plate for use in a speaker device or the like.

2. Prior Art

Metal titanium has been being widely used for acoustic vibration plates used in speakers or the like, since it has a small volume density and a large elastic modulus. In recent years, a proposal has been made for an acoustic vibration plate in which titanium oxide having a better characteristic than metal titanium is coated on the surface of metal titanium, to improve much more the acoustic characteristic of an acoustic vibration plate.

For example, Japanese Patent Application Laid-Open Publication No. 51-12130 proposes a speaker vibration plate obtained by forming a titanium oxide ($TiO_2$) layer on the surface of metal titanium in an argon atmosphere containing oxygen. In addition, Japanese Patent Application Laid-Open Publication No. 2-152399 proposes a vibration plate for a speaker in which a titanium oxide layer having a film thickness of 20 to 200 nm or a film thickness of 1 $\mu$m or more is formed on the surface of metal titanium by an anode oxidation method. The acoustic vibration plate obtained by forming a titanium oxide layer on the surface of metal titanium, as described above, has a higher rigidity in comparison with an acoustic vibration plate made of only metal titanium, so it has an excellent acoustic characteristic.

In addition to acoustic vibration plates using metal titanium, proposals have been made for an acoustic vibration plate using ceramics such as SiC or the like. Like the acoustic vibration plate using metal titanium, the acoustic vibration plate has a high rigidity, so it has an excellent acoustic characteristic. Considered as methods for preparing a vibration plate of this kind are a method of depositing ceramics such as SiC or the like in a shape like a vibration plate by a CVD method or the like, and a method of mixing and molding black lead and resins into a shape like a vibration plate and of thereafter sintering them to ceramic-carbonize the entire resultant.

However, the vibration plate as described above which is prepared by forming a titanium oxide layer on the surface of metal titanium has a very thin titanium oxide layer, compared with the thickness of metal titanium as a base material. Therefore, the acoustic characteristic of the vibration plate is not so improved as expected from the original excellent characteristic of titanium oxide itself.

Also, the method of preparing a vibration plate by depositing ceramics such as SiC or the like requires an expensive apparatus for preparing a thin film, such as a CVD apparatus or the like. Since this kind of thin-film preparation apparatus cannot process a large quantity of vibration plates together at once, the productivity is low so that the manufacturing cost is increased. In addition, it is difficult to prepare a vibration plate having a complicated shape by the method of mixing and ceramic-carbonizing black lead and resins to prepare a vibration plate.

Hence, the present invention has been proposed in view of the situation of the prior art as described above, and has an object of providing a method capable of manufacturing an acoustic vibration plate with a completed shape at low costs, which can provide an excellent reproducing characteristic within a high-frequency tone range when used in a speaker.

BRIEF SUMMARY OF THE INVENTION

To achieve the above object, a method for manufacturing an acoustic vibration plate according to the present invention comprises: a molding step of molding metal titanium into a shape of an acoustic vibration plate, to obtain a titanium vibration plate; and a ceramic-formation step for performing a heat treatment on the titanium vibration plate, thereby to change entirely the titanium vibration plate into titanium oxide.

In the above-described method for manufacturing an acoustic vibration plate, according to the present invention, metal titanium which has excellent processability is molded into the shape of the acoustic vibration plate thereby to prepare a titanium vibration plate, in the molding step. Next, in the ceramic-formation step, a heat treatment is carried out thereby changing the entire of the titanium vibration plate into titanium oxide. Therefore, an acoustic vibration plate which has a small volume density and a high elastic modulus can be manufactured in a desired shape.

DETAILED DESCRIPTION OF THE INVENTION

In the following, explanation will be made of specific embodiments of the method for manufacturing an acoustic vibration plate, according to the present invention.

Figure 1:
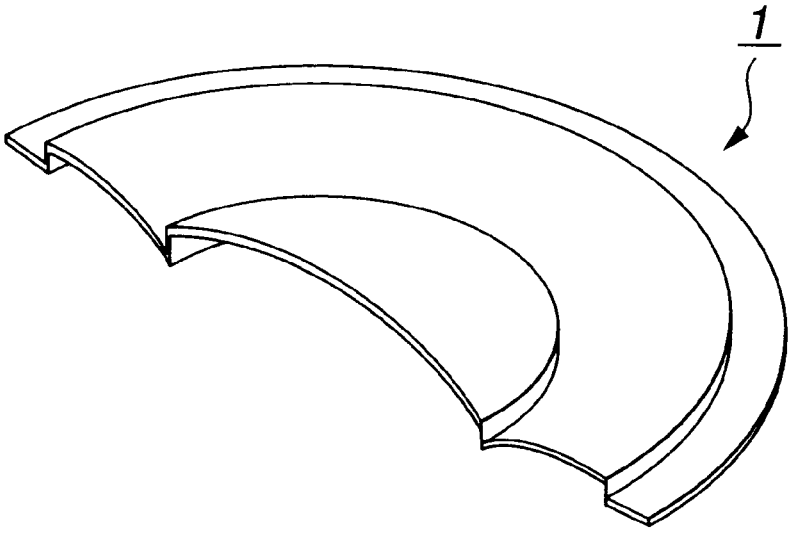
FIG. 1 is a partially-cutaway perspective view showing a main part of an acoustic vibration plate manufactured by the method for manufacturing an acoustic vibration plate, according to the present invention.

This method is intended to manufacture an acoustic vibration plate 1 which has a substantially disk-like shape with a flange on its outermost circumference and is entirely made of titanium oxide ($TiO_2$), as shown in FIG. 1. The titanium oxide has an excellent characteristic that the volume density is much smaller and the elastic modulus thereof is larger than those of metal titanium.

Further, the acoustic vibration plate 1 as described above is manufactured as described below.

At first, metal titanium is molded into a predetermined shape of an acoustic vibration plate thereby to form a titanium vibration plate made of metal titanium.

The method of molding metal titanium into the shape of an acoustic vibration plate will be, for example, press processing or the like. The metal titanium has an excellent processability so that it can be easily molded into a desired shape even when a complicated shape is required for the acoustic vibration plate. Although FIG. 1 shows an acoustic vibration plate 1 which has a substantially disk-like shape and has a dome-like center part, the acoustic vibration plate can have any shape, such as a substantially rectangular shape, a substantially circular shape, or the like, in compliance with the purpose of use.

Next, the titanium vibration plate is set in a furnace of a heat treatment apparatus, to make a heat treatment on the titanium vibration plate molded into the desired shape. Heat treatment conditions are then adjusted.

The heat treatment can be performed under the condition of being in an inactive gas atmosphere containing oxygen, an inactive gas atmosphere containing oxygen and moisture, a nitrogen gas atmosphere containing oxygen, a nitrogen gas atmosphere containing oxygen and moisture, an oxygen atmosphere, an oxygen atmosphere containing moisture, an ozone gas atmosphere, an inactive gas atmosphere containing moisture, a nitrogen gas atmosphere containing moisture, or the air.

Figure 2:
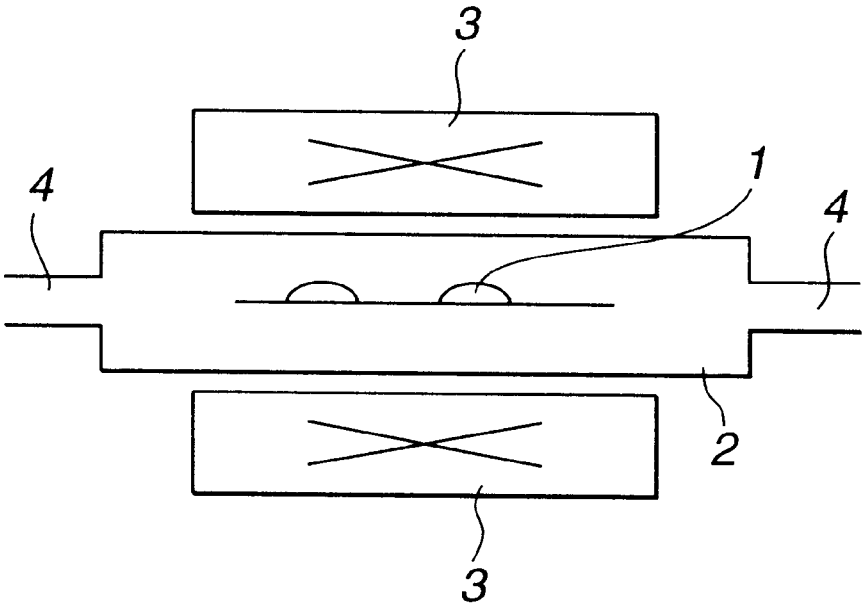
FIG. 2 is a schematic view showing an example of a heat treatment apparatus.

In case of adopting the condition of being in the air, it is possible to use a heat treatment apparatus having a structure comprising a furnace 2 where the titanium vibration plate is set, a heater 3 for heating the furnace 2, and a ventilation port 4 for ventilating the air, as shown in FIG. 2, for example. At this time, the inside of the furnace 2 may be sealed or may communicate with the air in the outside.

Figure 3:
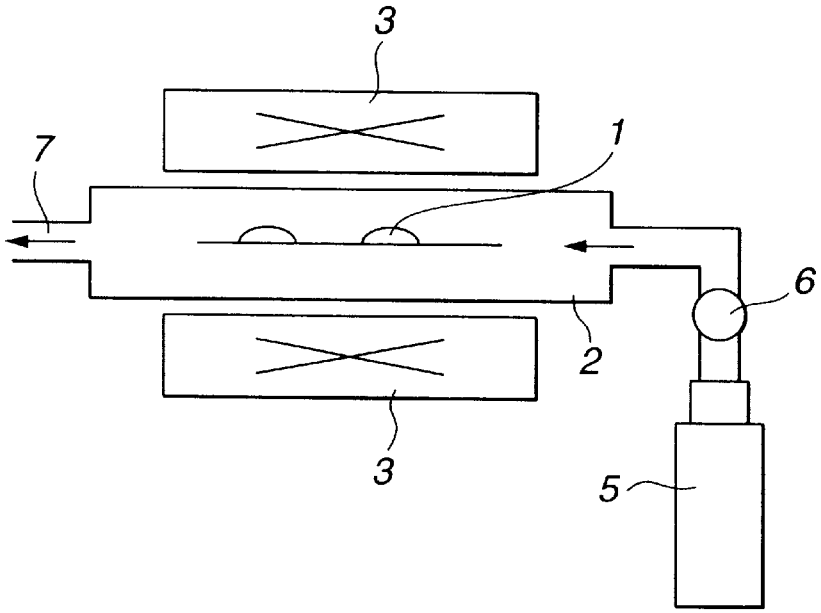
FIG. 3 is a schematic view showing another example of the heat treatment apparatus.

In case of adopting the condition of being in the atmosphere of oxygen, the inactive gas containing oxygen, the nitrogen gas containing oxygen, or the ozone gas (which will be summarized as a gas containing oxygen hereinafter), it is possible to use a heat treatment apparatus having a structure comprising a furnace 2 where the titanium vibration plate is set, a heater 3 for heating the furnace 2, a tank 5 for storing the gas containing oxygen, a valve 6 for adjusting the supply amount of the gas containing oxygen, and an exhaust port 7 for exhausting the gas containing oxygen, for example, as shown in FIG. 3.

After the titanium vibration plate is set in the furnace 2 of this heat treatment apparatus, the valve 6 is released to supply the gas containing oxygen from the tank 5 into the furnace 2. The air in the furnace 2 is substituted with the gas containing oxygen. After substituting the air with the gas containing oxygen, the gas containing oxygen may be kept supplied to the furnace 2 or may be stopped.

Figure 4:
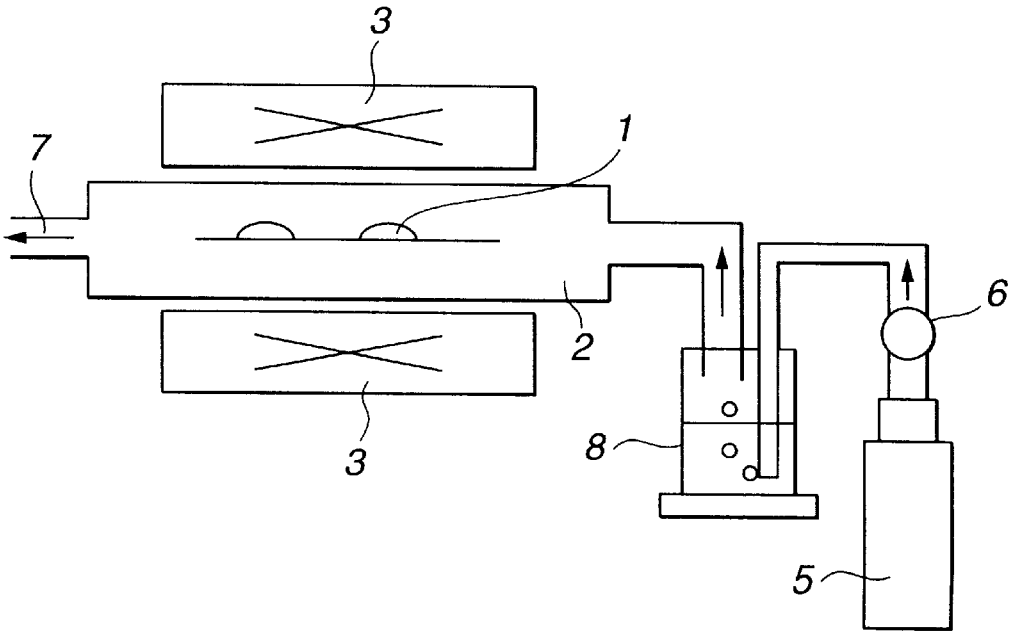
FIG. 4 is a schematic view showing further another example of heat treatment apparatus.

In case of adopting the condition of being in the atmosphere of the inactive gas containing oxygen and moisture, the nitrogen gas containing oxygen and moisture, the inactive gas containing moisture, or the nitrogen gas containing moisture (which will be hereinafter summarized a gas containing moisture), it is possible to use a heat treatment apparatus having a structure comprising a furnace 2 where the titanium vibration plate is set, a heater 3 for heating the furnace 2, a tank 5 for storing a gas, a valve 6 for adjusting the supply amount of the gas containing oxygen, a babbler 8 for changing the gas supplied from the tank 5 into a gas containing moisture, and an exhaust port 7 for exhausting the gas containing moisture, as shown in FIG. 4, for example. In this heat treatment apparatus, the gas stored in the tank 5 is let pass through water by the babbler 8 so that moisture can be easily contained into the gas.

After the titanium vibration plate is set in the furnace 2 of this heat treatment apparatus, the valve 6 is released to supply the gas containing oxygen from the tank 5 into the furnace 2. The air in the furnace 2 is substituted with the gas containing moisture. After substituting the air with the gas containing moisture, the gas containing moisture may be kept supplied to the furnace 2 or may be stopped.

Next, the heater 3 is heated to increase the temperature inside the furnace 2 to a temperature necessary for a heat treatment. It is preferred that the speed of increase of the temperature inside the furnace 2 should appropriately adjusted so as not to deform or damage the titanium vibration plate.

Next, the inside of the furnace 2 is maintained at a predetermined temperature to make a heat treatment on the titanium vibration plate. As a result, the entire titanium vibration plate is changed into ceramics thereby to form titanium oxide.

The heat treatment described above should preferably be carried out at a temperature of 880° C. or more. By performing the heat treatment at a temperature equal to or higher than the transformation temperature of titanium, titanium oxide is created with a large number of such holes formed therein that can be observed through an electron microscope. This kind of titanium oxide has a small volume density and a large elastic modulus, so it attains excellent rigidity. If the heat treatment temperature of the titanium vibration plate is 880° C. or less, decrease of the volume density and increase of the elastic modulus are insufficient, and titanium oxide which does not show excellent rigidity inherent to titanium oxide may be created.

Finally, the inside of the furnace 2 is cooled after completion of the heat treatment. An acoustic vibration plate 1 which is entirely made of titanium oxide is prepared. Cooling after completion of the heat treatment may be either natural cooling or forced cooling using cooling water or the like as long as the acoustic vibration plate 1 is not deformed or damaged.

Since this acoustic vibration plate 1 is entirely made of titanium oxide, the excellent characteristic inherent to titanium oxide can be extracted sufficiently. For example, the reproducing characteristic is excellent particularly in the high-frequency tone range when it is used for a speaker.

Although titanium oxide has a very excellent characteristic as an acoustic vibration plate, it is difficult to mold titanium oxide into a complicated shape. However, according to the present method, metal titanium which is excellent in processability is previously molded into a shape of an acoustic vibration plate, and thereafter, the metal titanium thus molded is changed into ceramics to create titanium oxide. That is, an acoustic vibration plate 1 which is entirely made of titanium oxide can be easily molded. In addition, a large quantity of plates can be changed simultaneously into ceramics without using an expensive thin-film-forming apparatus such as a CVD apparatus or the like. Therefore, the acoustic vibration plate 1 which is entirely made of titanium oxide can be prepared at low costs.

EMBODIMENTS

Acoustic vibration plates were prepared by using the method for manufacturing an acoustic vibration plate, according to the present invention.

Samples 1

Prepared at first were two types of titanium vibration plates made of metal titanium, one of which was 20 $\mu$m thick and the other of which was 30 $\mu$m thick. These titanium vibration plates were molded such that each of the plates becomes a desired acoustic vibration plate. In addition to the two types of titanium vibration plates, a strip of metal titanium having a thickness of 20 $\mu$m was prepared for measurement.

Next, the two types of titanium vibration plates and the metal titanium strip were set in a heat treatment apparatus as shown in FIG. 2, and the internal temperature of the furnace was raised. At this time, the furnace may be sealed or communicate the air with the outside. The temperature inside the furnace was increased from 25° C. to 900° C. as the transformation temperature of metal titanium for one hour and a half.

Next, the inside of the furnace was maintained at 900° C. until each of the titanium vibration plates became entirely oxide titanium, and thus, a heat treatment was performed on the titanium vibration plates. The titanium vibration plate having a thickness of 20 $\mu$m required 30 minutes or more to maintain the temperature, as well as the titanium vibration plate having a thickness of 30 $\mu$m required 60 minutes or more.

Finally, the furnace was subjected to natural cooling, and thus, acoustic vibration plate were obtained as samples 1 which are entirely made of titanium oxide.

Figure 5:
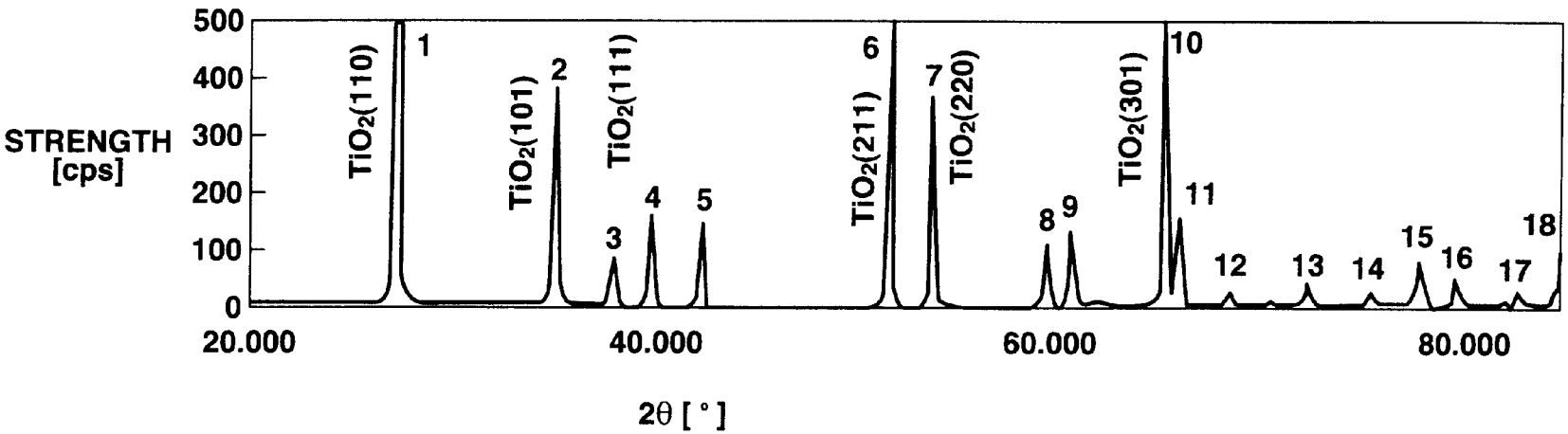
FIG. 5 is a graph showing X-ray diffraction patterns of acoustic vibration plates manufactured by the method for manufacturing an acoustic vibration plate, according to the present invention.

The acoustic vibration plates and the titanium oxide strip thus obtained were in yellow white color. FIG. 5 shows X-ray diffraction results of the acoustic plates. From the observed diffraction peak, the material which has resulted from the heat treatment was found to be rutile type titanium oxide.

Although the titanium plates had SR of 14. 7 mm at the dome part in the center and an inner diameter of 17.5 mm before the heat treatment, the inner diameter of the acoustic vibration plates changed to 17.7 mm after the heat treatment.

Samples 2

Acoustic vibration plates and a titanium oxide strip were prepared in the same manner as in the case of the samples 1 except that a heat treatment apparatus as shown in FIG. 3 was used for the heat treatment and that the furnace was internally maintained in a gas atmosphere containing oxygen. The acoustic vibration plates and the titanium oxide strip thus obtained were in yellow white color, like the samples 1.

Samples 3

Acoustic vibration plates and a titanium oxide strip were prepared in the same manner as in the case of the samples 1 except that a heat treatment apparatus as shown in FIG. 4 was used for the heat treatment and that the furnace was internally maintained in a gas atmosphere containing moisture. The acoustic vibration plates and the titanium oxide strip thus obtained were in yellow white color, like the samples 1.

Samples 4

Acoustic vibration plates and a titanium oxide strip were prepared in the same manner as in the case of the samples 1 except that the heat treatment was carried out with the temperature inside the furnace maintained at 850° C. The acoustic vibration plates and the titanium oxide strip thus obtained were in gray color.

Evaluation of Characteristics

Figure 6A:
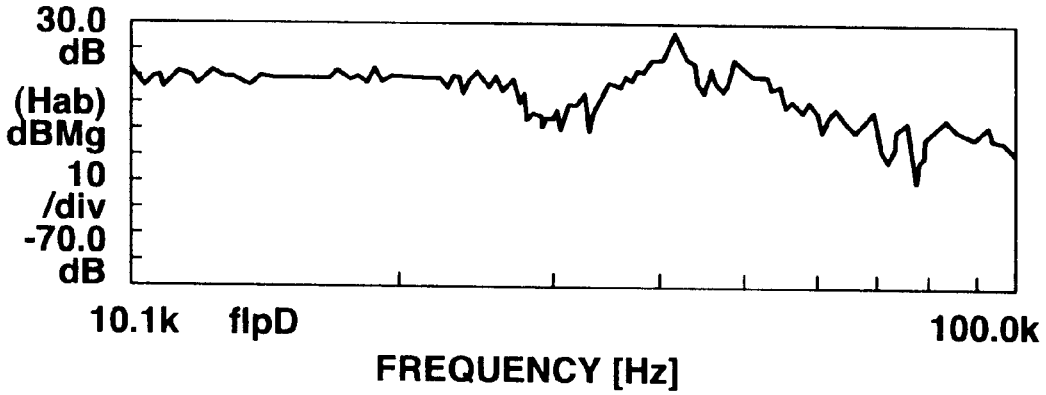
FIG. 6(*a*) is a characteristic graph showing frequency characteristics of the sound pressure of a speaker unit prepared with use of a titanium vibration plate before a heat treatment, and FIG. 6(*b*) is a characteristic graph showing frequency characteristics of the sound pressure of a speaker unit prepared with use of an acoustic vibration plate of samples 1.
Figure 6B:
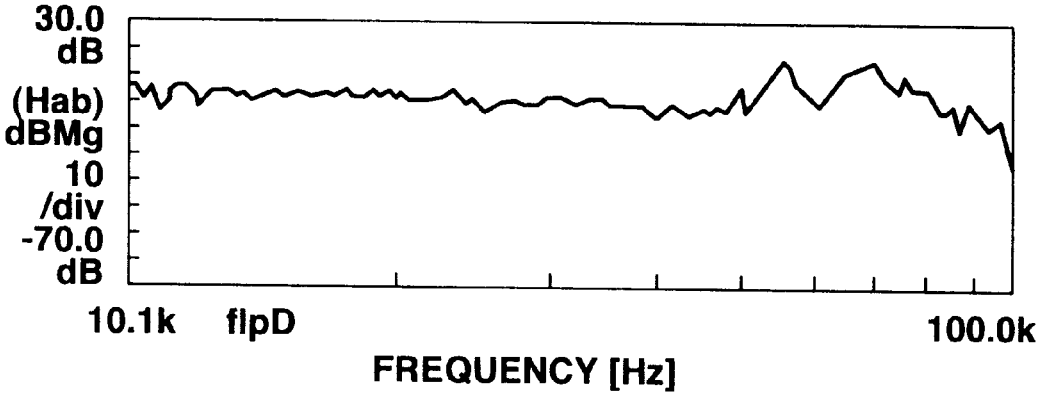

Speaker units were prepared with use of the acoustic vibration plates prepared in the manner as described above, and frequency characteristics of their sound pressures were measured. For comparison, a speaker unit was prepared with use of a titanium vibration plate before a heat treatment, and frequency characteristics of its sound pressure were measured. Measurement results thereof are shown in FIG. 6(*a*).

A speaker unit was prepared with use of an acoustic vibration plate of the samples 1, and frequency characteristics of its sound pressure were measured. Measurement results thereof are shown in FIG. 6(*b*). As is apparent from FIG. 6, it is found that the high-frequency tone range up to 100 kHz can be reproduced by using the acoustic vibration plate subjected to the heat treatment for the speaker unit.

Next, the thickness, volume density, elastic modulus, and propagation velocity of longitudinal elastic wave were measured and evaluated with respect to the titanium oxide strips of the obtained samples 1 to 4 and the metal titanium strips before the heat treatment. Measurement results were shown in Table 1. Note that the measurement results of the samples 2 and 3 were substantially the same as those of the samples 1 and therefore omitted from the table 1.

TABLE 1

| | heat treatment temp. (° C.) | thickness (mm) | volume density (kg/m$^3$) | elastic modulus (GPa) | longitudinal wave velocity (m/sec.) |
|---|---|---|---|---|---|
| Sample 1 | 900 | 0.04 | 3600 | 270 | 8660 |
| Sample 4 | 800 | 0.04 | 4196 | 240 | 7563 |
| Sample before heat treatment | — | 0.02 | 4500 | 110 | 4944 |

As is apparent from the table 1, the thickness of the sample 1 became twice that of the sample before the heat treatment. However, the volume density of the sample 1 became smaller. The elastic modulus of the sample 1 became twice or more greater. The propagation velocity of longitudinal elastic wave of the sample 1 was improved greatly. Thus, the sample 1 showed excellent characteristics inherent to titanium oxide because the heat treatment was carried out at a temperature equal to or higher than the transformation temperature of metal titanium.

On the other hand, the sample 4 showed inferior characteristics in all of the volume density, elastic modulus, and the propagation velocity of longitudinal elastic wave compared with those of the sample 1. That is, it is found that the sample 4 could not attain characteristics inherent to titanium oxide because the heat treatment was carried out at a temperature of 850° C., lower than the transformation temperature of metal titanium.

Among the samples 1 to 3, the acoustic vibration plates according to the samples 1 could be prepared at the lowest costs.

What is claimed is:

1. A method for manufacturing an acoustic vibration plate comprising the steps of:

molding titanium metal into a shape of an acoustic vibration plate to obtain a titanium vibration plate; and performing a heat treatment on the titanium vibration plate by practicing ceramic formation, thereby changing the titanium vibration plate entirely into titanium oxide.

2. The method according to claim 1, wherein the heat treatment is carried out at a temperature of 880° C. or more in the ceramic-formation step.

* * * * *